US007179132B2

(12) United States Patent
Flowers

(10) Patent No.: US 7,179,132 B2
(45) Date of Patent: Feb. 20, 2007

(54) ELECTRICAL CONNECTOR WITH IMPROVED TERMINAL MOUNTING HOUSING MEANS

(75) Inventor: Robert J. Flowers, Ortonville, MI (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/922,520

(22) Filed: Aug. 20, 2004

(65) Prior Publication Data

US 2006/0040534 A1 Feb. 23, 2006

(51) Int. Cl.
*H01R 13/502* (2006.01)

(52) U.S. Cl. ..... 439/686

(58) Field of Classification Search ..... 439/686, 439/752, 689, 595, 157
See application file for complete search history.

(56) References Cited

U.S. PATENT DOCUMENTS 4,820,198 A * 4/1989 Lulko et al. ..... 439/595
5,378,176 A * 1/1995 Sasai ..... 439/752
5,738,551 A * 4/1998 Matsuoka ..... 439/752

* cited by examiner

*Primary Examiner*—Javaid H. Nasri
(74) *Attorney, Agent, or Firm*—Romi N. Bose

(57) ABSTRACT

An electrical connector includes a first housing part having first walls, and a second housing part is engageable with the first housing part and has second walls. The first and second walls of the two housing parts combine to define different sides of a plurality of terminal-receiving cavities for mounting a plurality of conductive terminals. The first walls define at least one side of each cavity, and the second walls define at least an opposite side of the cavity.

16 Claims, 9 Drawing Sheets

ELECTRICAL CONNECTOR WITH IMPROVED TERMINAL MOUNTING HOUSING MEANS

FIELD OF THE INVENTION

This invention generally relates to the art of electrical connectors and, particularly, to an electrical connector having a two-part housing means to facilitate molding terminal-receiving cavities therein.

BACKGROUND OF THE INVENTION

A typical electrical connector includes some form of dielectric housing which mounts a plurality of conductive terminals. The housing may be molded of plastic material and the terminals may be stamped and formed of sheet metal material, for instance. The connector will mate with a complementary connecting device or a second mating connector, whereby the respective terminals of the connectors are engaged to establish an electrical circuit(s) through the mating connectors. For instance, a receptacle or female connector matingly receives a plug or male connector.

With the ever-increasing terminal density of electrical connectors, it has become increasingly difficult to mold the cavities within which the terminals are inserted into the connector housings. An example is in the automotive industry where a single connector which, itself, may have size restrictions must mount an increasing number of terminals for conducting multiple circuit functions within the vehicular system. In order to increase the number of terminals, the spacing between the terminals must be decreased. The terminals are surrounded by plastic material of the connector housing that performs several functions: namely, lead-in of the inserted terminals, alignment of the terminals and providing side electrical insulation from adjacent terminals. The insulation is accomplished by walls molded about the terminal-receiving cavities. These walls must be made thinner and thinner to increase the number of terminals that a given connector can receive. Other than the fact that there is a limit to the thinness of the walls, most terminals are elongated and the respective terminal-receiving cavities have considerable lengths. Even the terminals, themselves, are miniaturized. All of these reductions in size parameters make it extremely difficult, if at all possible, to mold the side walls of terminal-receiving cavities in such high density connectors. The present invention is directed to solving these problems.

SUMMARY OF THE INVENTION

An object, therefore, of the invention is to provide a new and improved electrical connector assembly to facilitate the fabrication of the terminal-receiving cavities in connector housings.

In the exemplary embodiment of the invention, a first housing part has wall means, and a second housing part is engageable with the first housing part and has second wall means. The first and second wall means of the two housing parts combine to define different sides of a plurality of terminal-receiving cavities for mounting a plurality of conductive terminals. The first wall means define at least one side of each cavity, and the second wall means define at least an opposite side of the cavity.

As disclosed herein, the first housing part mounts a plurality of terminals and has a mating face for mating with a complementary mating connector. The second housing part comprises a terminal position assurance device (TPA) mounted across the mating face of the housing and having the second wall means thereon.

According to one aspect of the invention, the cavities are elongated generally perpendicular to the mating face of the housing. The first and second wall means extend substantially the length of the cavities.

According to another aspect of the invention, the first wall means of the housing defines at least one side of a generally rectangular cavity for receiving a generally rectangular terminal. The first wall means is generally U-shaped in cross-section to define approximately one-half of the generally rectangular cavity. The second wall means of the TPA is generally U-shaped in cross-section to define approximately the other half of the generally rectangular cavity.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the FIGS. and in which:

DETAILED DESCRIPTION OF THE PREFERRED EMBODIMENT

Figure 1:
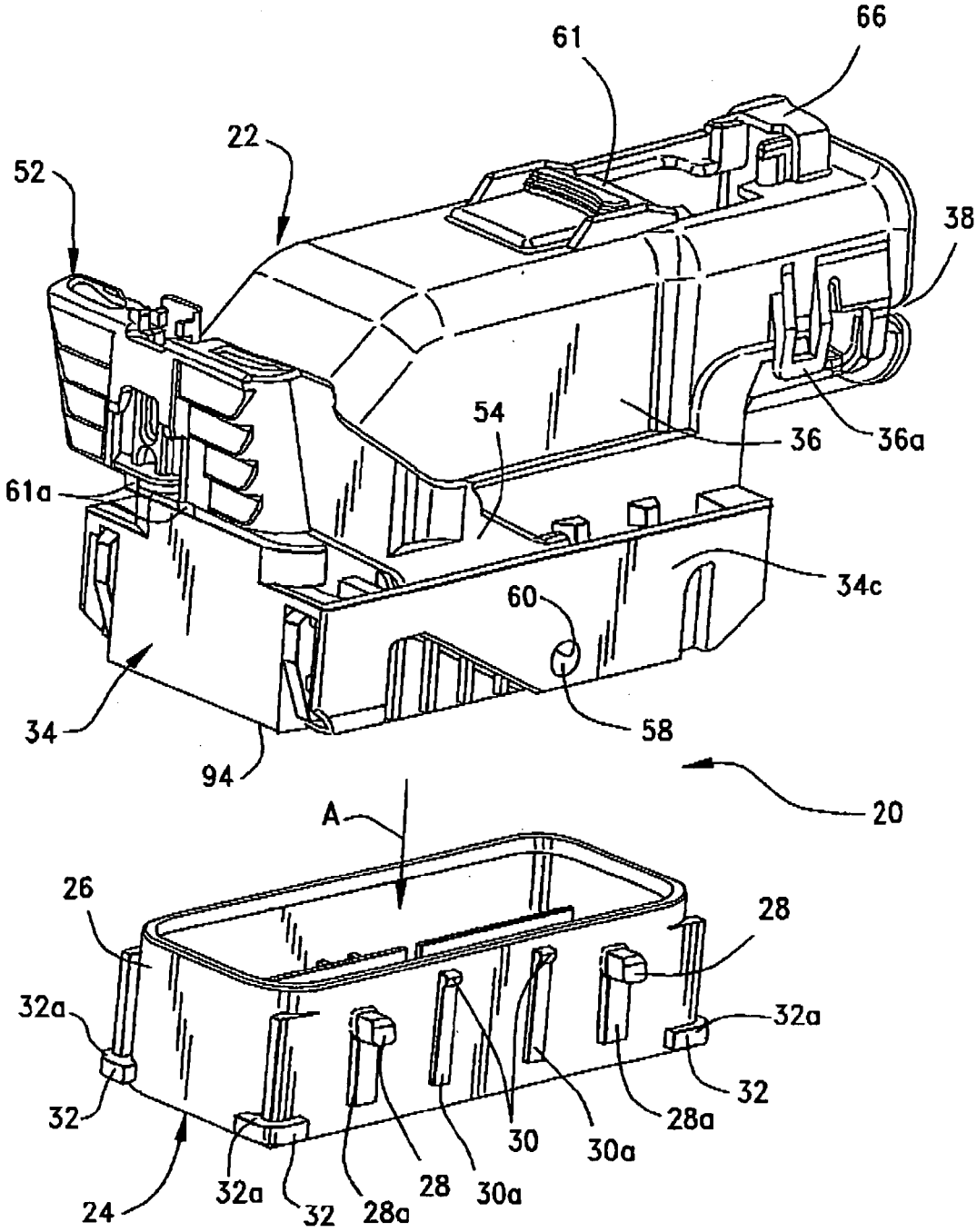
FIG. 1 is a perspective view of a lever type electrical connector assembly incorporating the concepts of the invention.
Figure 2:
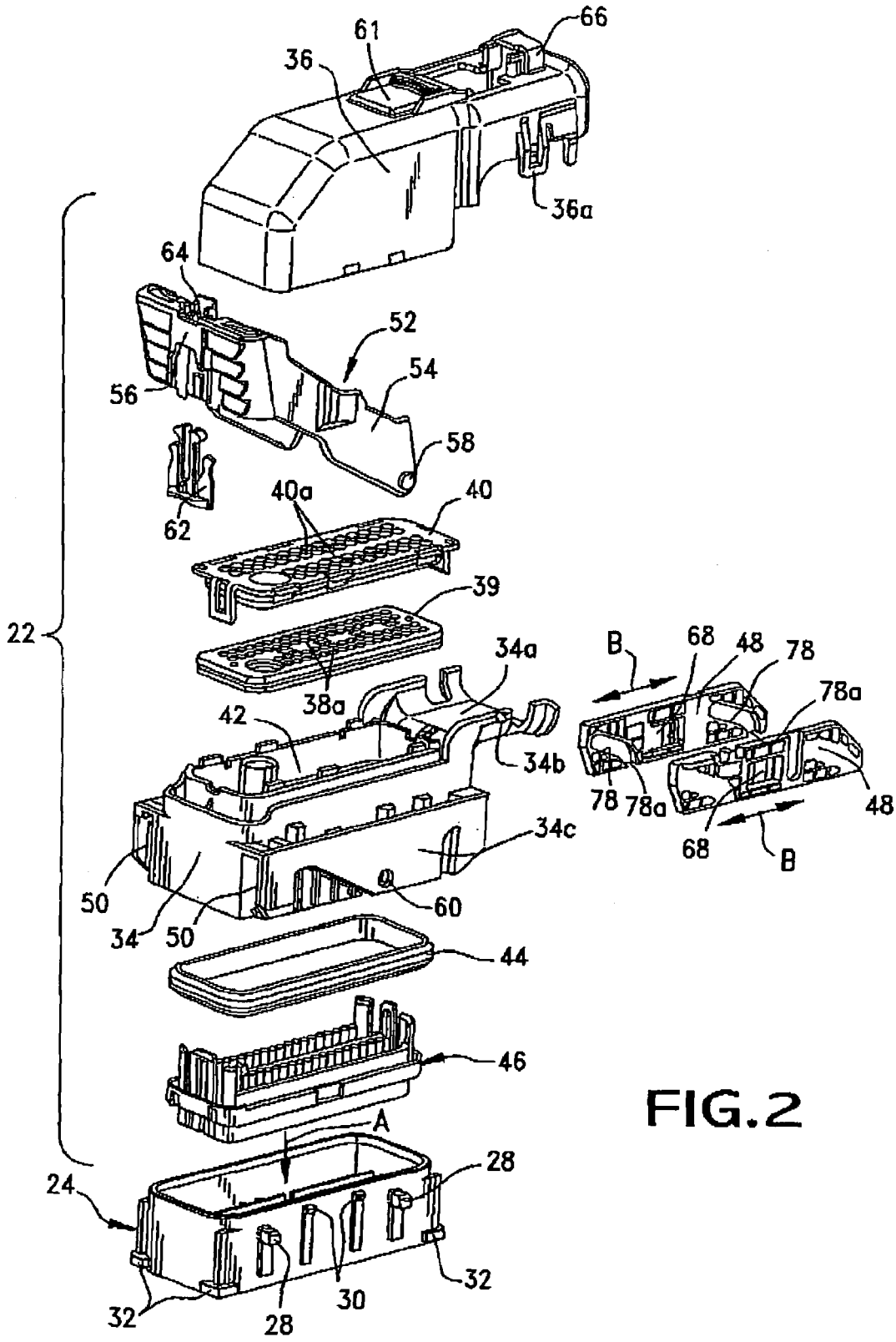
FIG. 2 is an exploded perspective view of the connector assembly.

Referring to the drawings in greater detail, and first to FIGS. 1 and 2, the invention is embodied in a lever type electrical connector assembly, generally designated 20. The assembly includes a first ("actuator") connector, generally designated 22, and a second ("mating") connector, generally designated 24. The connectors are shown separated in FIG. 1; in a pre-mated or preliminary position in FIG. 3; in an intermediate (interference) position in FIG. 4; and in a fully mated position in FIG. 5, as will be explained hereinafter.

Mating connector 24 (FIGS. 1 and 2) is a header connector which may be mounted on an electronics module chassis or frame in an automobile, for instance. Therefore, the connector assembly is applicable for use in high vibration and impact environments, although the assembly can be used in other applications. In actual practice, the assembly has been used directly on the motor chassis of a vehicle where vibrations and impacts are quite severe.

Mating connector 24 includes a plug housing 26 which is insertable into actuator connector 22 in the direction of arrow "A" (FIG. 1). For purposes described hereinafter, a pair of cam follower posts 28 project outwardly from each opposite side of plug housing 26. A pair of detent projections 30 also project outwardly from each opposite side of the plug housing. Although only one detent projection 30 on each opposite side of the plug housing is functional, two projections are formed on each side so that the mating connector can be mounted in reversed orientations. The housing is a unitary structure which may be molded of plastic material, with reinforcing ribs 28*a* supporting cam follower posts 28, and reinforcing ribs 30*a* supporting detent projections 30. Plug housing 26 is generally rectangular, and an abutment platform 32 projects outwardly from each corner of the housing at the base thereof. Each abutment platform defines an interference surface 32 which faces upwardly toward actuator connector 22, for purposes described hereinafter. Plug housing 26 of mating connector 24 mounts a plurality of conductive terminals which are not visible in these drawings.

FIG. 2 shows mating connector 24 in conjunction with an exploded depiction of the components of actuator connector 22. The actuator connector includes a molded plastic housing, generally designated 34, and a shroud or cover 36 which substantially covers the top of the housing. The cover combines with a bracket portion 34*a* of housing 34 to provide an opening 38 (FIG. 1) for ingress/egress of an electrical cable having conductors terminated to the terminals within the connector housing, as described hereinafter. A flexible latch arm 36*a* is formed on each opposite side of cover 36 for latching into engagement with a pair of chamfered latch bosses 34*b* at opposite sides of bracket portion 34*a* of the housing.

Still referring to FIG. 2, a flat seal 39 and a molded plastic seal cap 40 are positionable into a cavity 42 of housing 34. The seal has apertures 38*a* and the seal cap has aligned apertures 40*a* through which the terminals of the electrical cable can be inserted into the housing for termination to the terminals therewithin. A perimeter seal 44 is positionable into the underside of housing 34 and is held in place by a terminal position assurance device (TPA), generally designated 46, and described in detail hereinafter. TPA 46 has holes 47 (FIG. 14) through which terminal pins from mating connector 24 can be inserted.

A pair of relatively thin slide members 48 are slidably mounted in a pair of horizontal passages 50 inside a pair of side walls 34*c* of housing 34. The slide members are linearly movably mounted within passages 50 for movement in the direction of double-headed arrows "B" which is generally perpendicular to the mating/unmating direction of connectors 22 and 24 as indicated by double-headed arrow "A" in FIG. 2. Further details of the slide members will be described hereinafter.

Still referring to FIG. 2, a generally U-shaped lever structure, generally designated 52, is pivotally mounted on housing 34 of actuator connector 22. The lever structure is rotatable in a pivotal operating stroke in the direction of arrow "C" (FIGS. 4 and 5) to draw mating connector 24 into mated condition with the actuator connector. The U-shaped lever structure defines a pair of actuating or mating assist lever arms 54 joined by a cross portion 56 which generally spans the width of the actuator connector. Each lever arm has a pivot boss 58 on the outside thereof. The lever structure preferably is fabricated of molded plastic material, and lever arms 54 are assembled behind side walls 34*c* of housing 34 until pivot bosses snap into pivot holes 60 in the side walls of the housing. The lever structure, thereby, is free to pivot relative to housing 34 about pivot means provided by pivot bosses 58 and pivot holes 60. A flexible primary lock tab 61 on cover 36 is engageable with primary lock tabs 61*a* on cross portion 56 of the lever to lock the lever when it is in its fully mated position as shown in FIG. 5. A secondary lock member 62 is reciprocally mounted in a passage 64 in cross portion 56 for locking engagement with a complementary locking means 66 on cover 36 when lever structure 52 is in its fully mated position.

Figure 3:
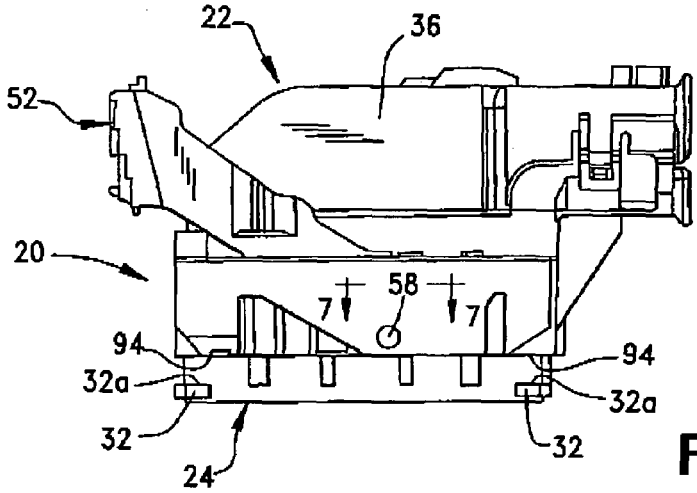
FIG. 3 is a side elevational view of the connector assembly, with the actuating connector positioned over the header connector, and with the mating assist lever in its pre-mated or preliminary position.
Figure 4:
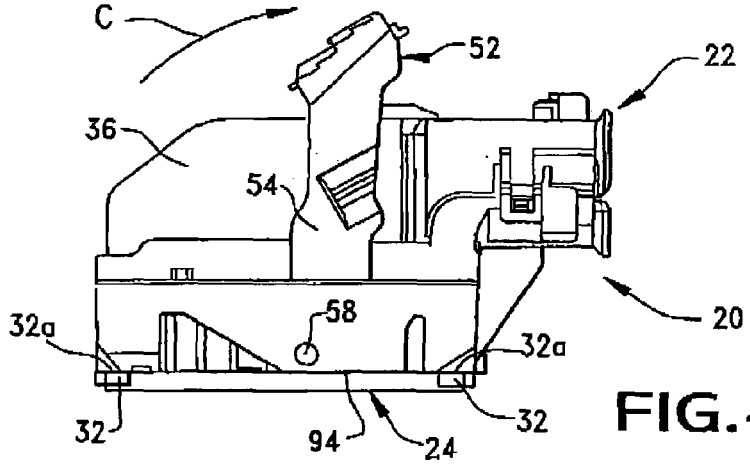
FIG. 4 is a view similar to that of FIG. 3, with the lever pivoted to an intermediate position pulling the header connector into engagement with the actuating connector.
Figure 5:
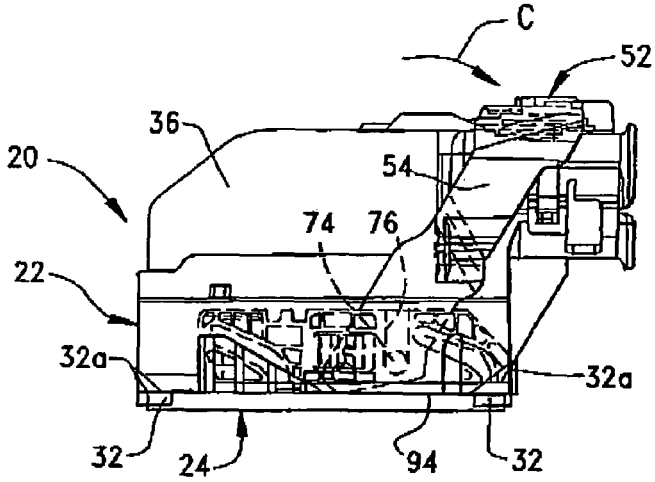
FIG. 5 is a view similar to that of FIG. 4, with the lever pivoted to its fully mated position.

FIGS. 3–5 show the various positions of lever structure 52 for reference purposes in the following detailed description of various features of the invention. Suffice it to say, FIG. 3 shows the lever structure in its pre-mated or preliminary position. FIG. 4 shows the lever structure in an intermediate, interference position. FIG. 5 shows the lever structure in its fully mated position.

Figure 6:
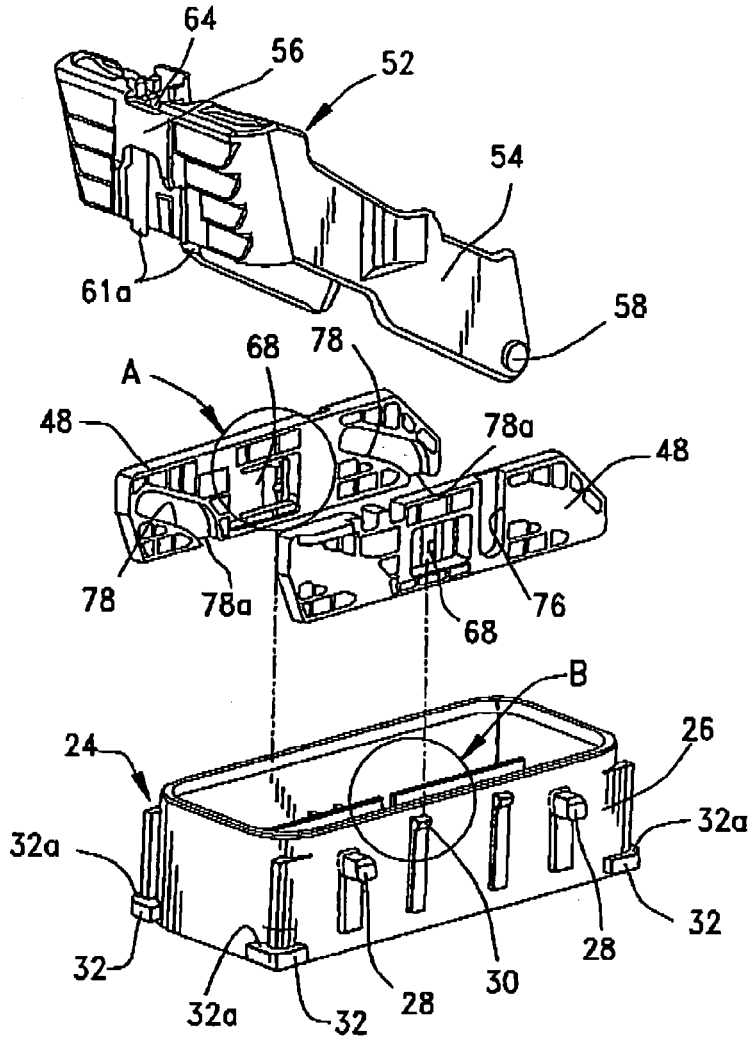
FIG. 6 is an exploded perspective view of the lever and slide members isolated from the actuating connector and in conjunction with the header connector.
Figure 6A:
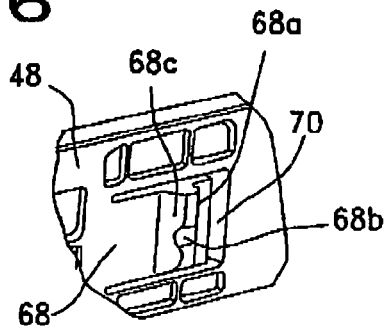
FIG. 6A is an enlargement of the area encircled at "A" in FIG. 6.
Figure 7A:
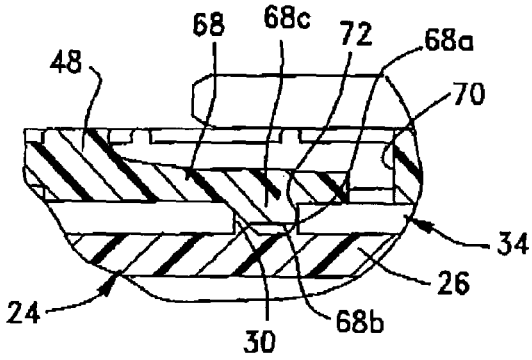
FIG. 7A is a fragmented vertical section taken generally along line 7A—7A of FIG. 3, with one of the flexible latch arms in its latched position.
Figure 7B:
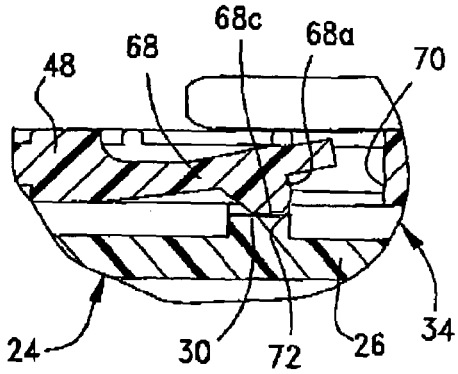
FIG. 7B is a view similar to that of FIG. 7A, with the flexible latch arm unlatched.

Referring to FIGS. 6–7B, each slide member 48 includes a latch arm 68. With the slide member preferably being molded of plastic material, the latch arm is cantilevered into and flexible within an opening 70 in the slide member as best seen in FIG. 6A. The slide member has a latch surface 68*a* which engages a latch surface 72 on housing 34 as seen in FIG. 7A. Therefore, in the pre-mated or preliminary position of lever structure 52, the interengagement of latch surfaces 68*a* on slide members 48 with latch surfaces 72 on the housing prevents pivotal movement of the lever structure. Each latch arm 68 also has a detent recess 68*b*, again as best seen in FIG. 6A. Detent recesses 68*b* and latch surfaces 68*a* are formed on enlargements 68*c* which project outwardly of the thin slide members.

Figure 6B:
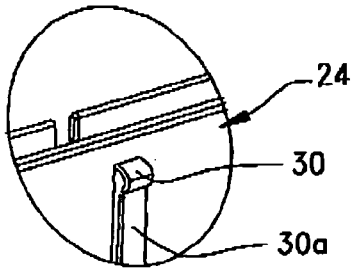
FIG. 6B is an enlargement of the area encircled at "B" in FIG. 6.

Referring specifically to FIGS. 6 and 6B, it can be seen that one of the detent projections 30 on the outside of plug housing 26 of mating connector 24 is aligned with the detent recess 68*b* of the flexible latch arm 68 of the slide member 48 on that side of connector 22. Therefore, when the connectors are preliminarily mated from the position shown in FIG. 1 to the position shown in FIG. 3, detent projections 30 on the outside of mating connector 24 engage enlargement 68*c* of flexible latch arms 68 and bias the latch arms out of their latching engagement with surfaces 72 (FIG. 7B) of housing 34 of the actuator connector. In addition, detent projections 30 "snap" into detent recesses 68*b* of the flexible latch arms to provide a feedback to an operator. When this mating action occurs, two functions are performed by the singular latch arm/detent projection system. First, the detent projections move the flexible latch arms out of their latching engagement. Second, the "snapping" of the detent projections into detent recesses 68*b* in the latch arms creates a tactile, and sometimes audible, feedback or indication of the preliminary mating of the connectors. In other words, flexible latch arms 68, in conjunction with detent projections 30, perform a dual function where the prior art required two distinct mechanisms to first, unlatch the slide members and to second, render a tactile indication.

Figure 8:
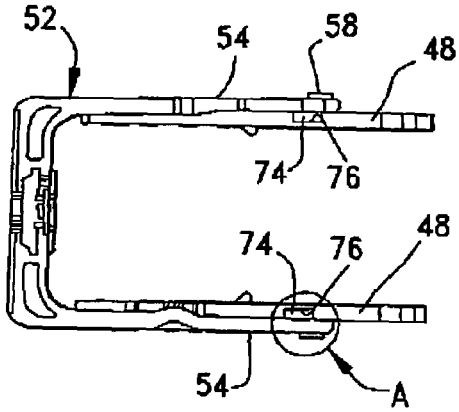
FIG. 8 is a top plan view of the mating assist lever in assembled condition with the slide members, isolated from the remainder of the actuating connector.
Figure 8A:
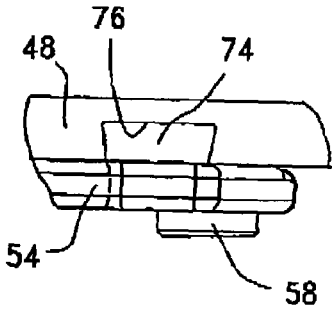
FIG. 8A is an enlargement of the area encircled at "A" in FIG. 8.
Figure 9:
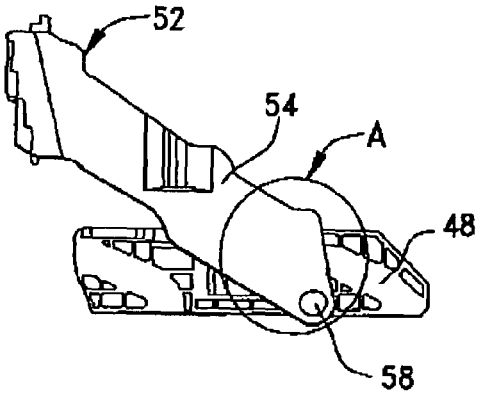
FIG. 9 is a side elevational view of the depiction in FIG. 8.
Figure 9A:
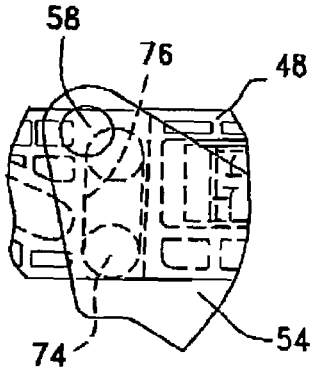
FIG. 9A is an enlargement of the area encircled at "A" in FIG. 9.
Figure 10:
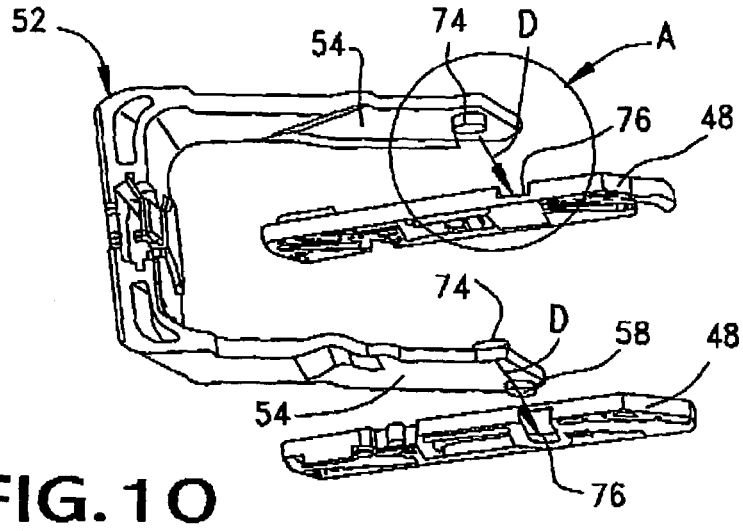
FIGS. 10 and 11 are sequential views showing the assembly of the lever to the slide members, with FIG. 10A showing an enlargement of the area encircled at "A" in FIG. 10.
Figure 10A:
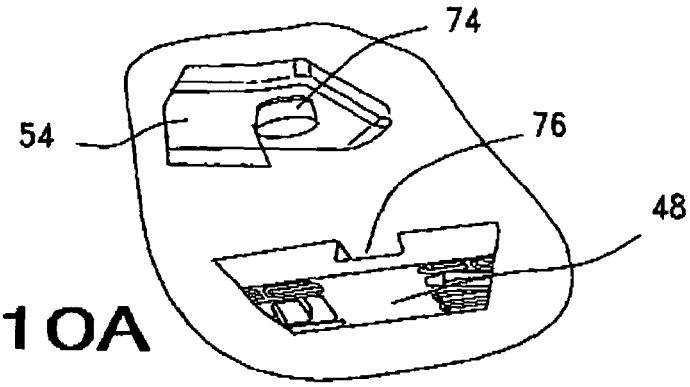
Figure 11:
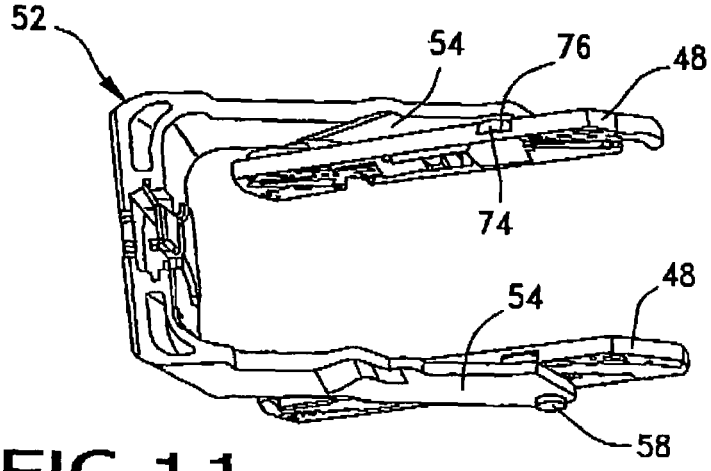

Generally, first cam follower and cam follower means are provided between the mating assist lever structure 52 and slide members 48 whereby pivotal movement of the lever structure relative to housing 34 effects linear movement of the slide members relative to the first and second connectors in a direction generally perpendicular to the mating direction of the connectors. Specifically, referring to FIGS. 8–10A, coupling joints are provided between the mating assist lever structure and the slide members by means of a cam follower post 74 projecting inwardly from each lever arm 54 of the lever structure, with each cam follower post being positioned in a cam groove 76 in a respective slide member. It can be seen in the drawings that lever arms 54 of the lever structure and slide members 48 are relatively thin, planar components. In addition, with the lever structure and the slide members being molded of plastic material, there is some flexibility in the components. Consequently, heretofore there has been a considerable problem in cam follower posts 74 pulling out of cam grooves 76 which causes mating and unmating problems with the connector assembly. This disengagement of the lever arms from the slide members is prominent in high impact applications, such as automotive applications. Disengagement can become a problem due to normal wear in one or both of the components due to forces exerted on the lever structure. In automotive applications, the components also become quite dirty, and large forces on the lever can cause disengagement from the slide members. Consequently, as best seen in FIGS. 8A and 10A, both cam follower posts 74 as well as cam grooves 76 are formed with dovetail configurations. This prevents the lever arms from separating from the slide members. The cam grooves are open-sided, but the dovetail configurations prevent the posts from pulling out of the open sides of the grooves. The lever structure is assembled to the slide members in the direction of arrows "D" (FIG. 10) simply by inserting the dovetail configured cam follower post 74 into the open top of cam grooves 46.

Generally, second cam groove and cam follower means are provided between slide members 48 and mating connector 24, whereby the connectors are mated and unmated in response to rotation of the mating assist lever structure 52 and resulting translation of the slide members. Specifically, as best seen in FIGS. 2 and 6, each slide member 48 is provided with a pair of angled cam grooves 78 molded in the inside surfaces of the planar slide members. The cam grooves have open mouths 78*a*. When the connectors are preliminarily mated as shown in FIG. 3, cam follower posts 28 which project outwardly from opposite sides of plug housing 26 of mating connector 24, move into open mouths 78*a* of cam grooves 78 of slide members 48. Therefore, when lever structure 52 is rotated in the direction of arrows "C", the lever moves slide members 48 linearly due to the interengagement of cam follower posts 74 on the lever structure located within cam grooves 76 of the slide members. In turn, linear movement of the slide members transversely of the mating direction of the connectors, causes angled cam grooves 78 to pull the connectors into mated condition as cam follower posts 28 ride in angled cam grooves 78.

FIGS. 12–15 show a system which allows connector 22 to mount a high density of terminals than otherwise would be possible. Specifically, increased numbers of terminals (i.e., higher density) is being required in many connector applications. This is particularly true in automotive applications. In general, conductive terminals are mounted in connector housings and are surrounded by the plastic material of the housing to perform various functions, such as lead-in alignment and side insulation between adjacent terminals. The insulation is accomplished by side walls which surround each terminal. Unfortunately, within any given connector envelope, the side walls become thinner and thinner when the density of the terminals increases. This causes severe problems in the connector housing design, particularly in being able to mold the housing with thin walls along a considerable length of an elongated terminal.

Figure 12:
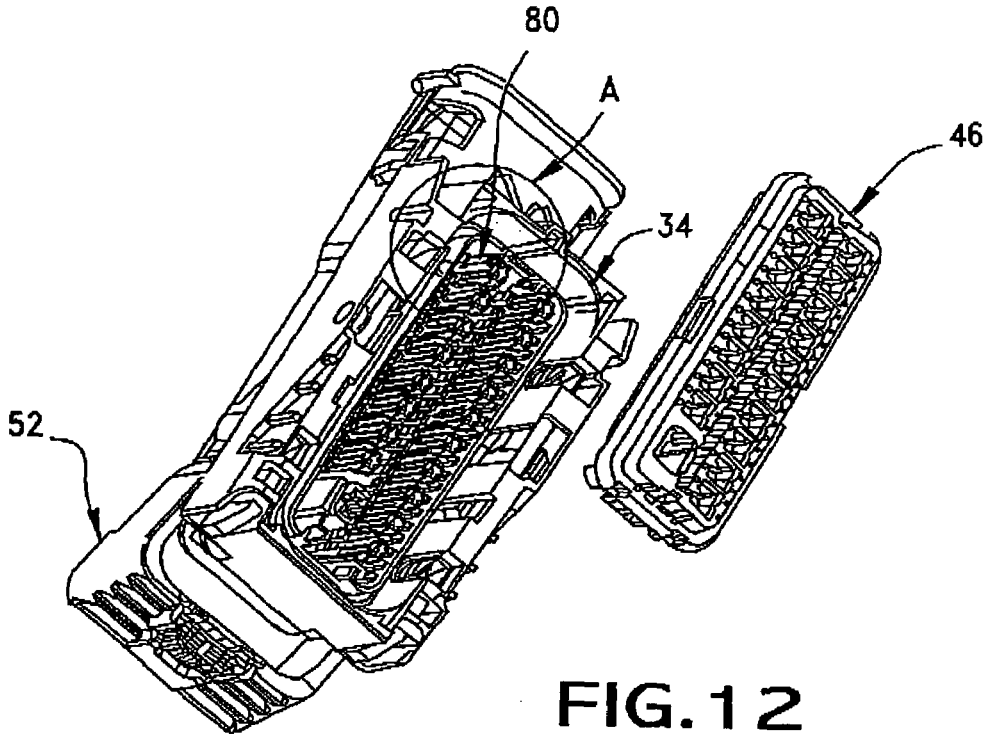
FIG. 12 is a perspective view looking into the housing of the actuating connector, with one terminal mounted therein, and with the terminal position assurance device (TPA) lifted therefrom.
Figure 12A:
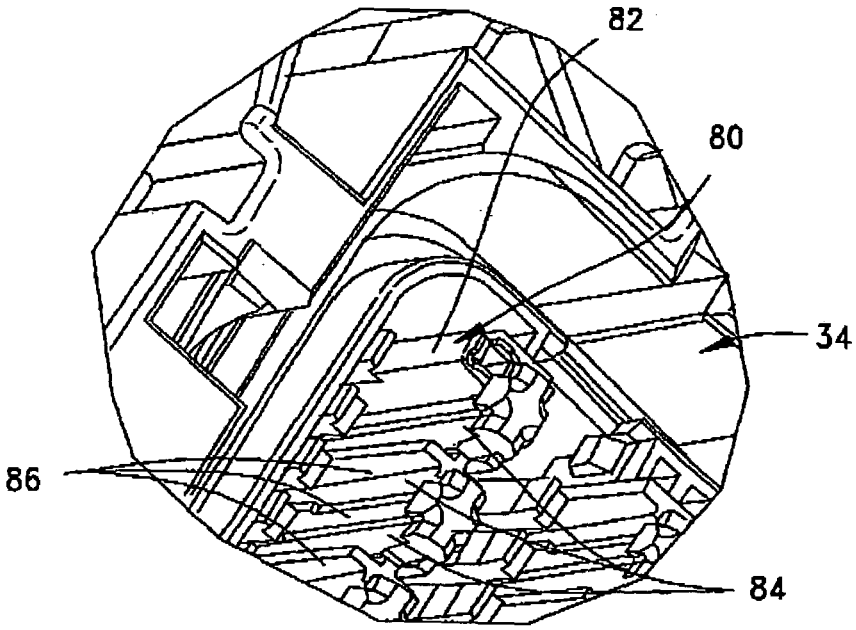
FIG. 12A is an enlargement of the area encircled at "A" in FIG. 12.
Figure 14:
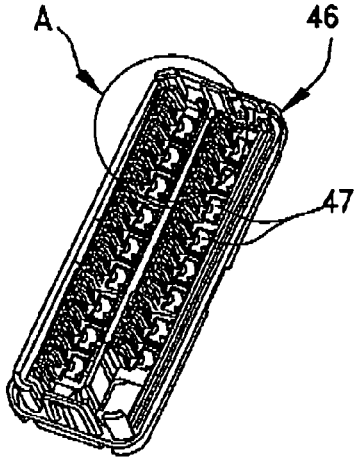
FIG. 14 is a perspective view looking at the underside of the TPA.
Figure 14A:
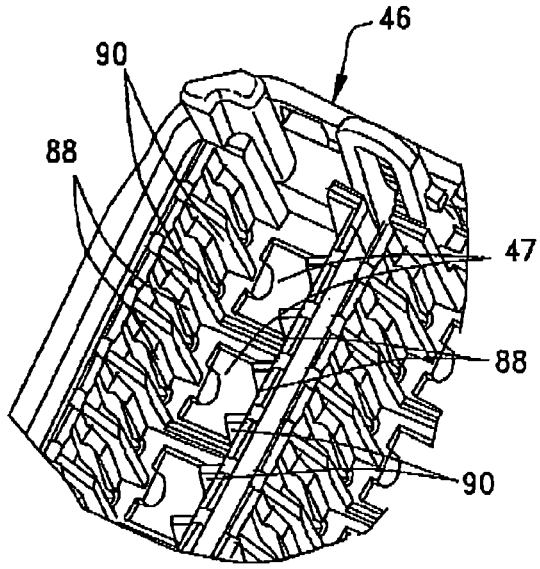
FIG. 14A is an enlargement of the area encircled at "A" in FIG. 14.
Figure 13:
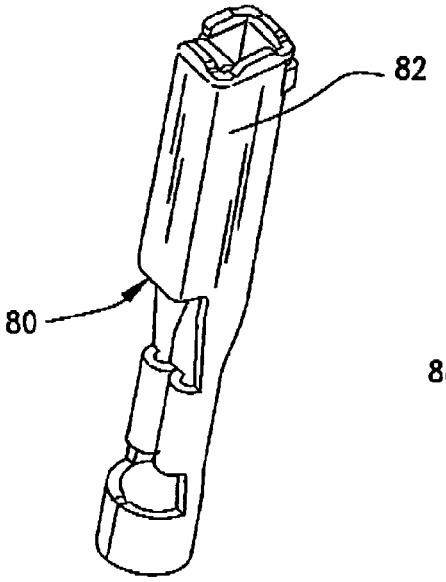
FIG. 13 is a perspective view of one of the terminals.
Figure 15:
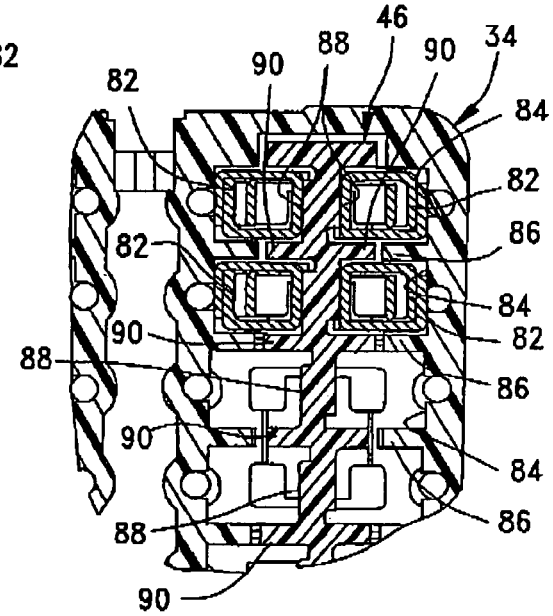
FIG. 15 is a fragmented section through the walls of the connector housing and the TPA surrounding some of the terminals.
Figure 16:
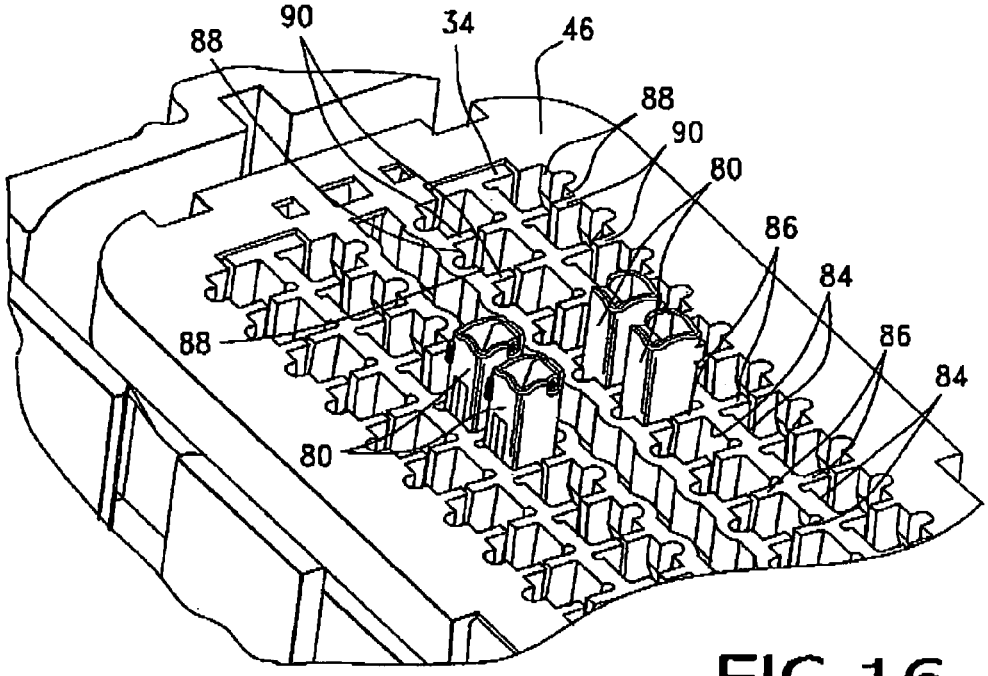
FIG. 16 is a perspective view of the connector of FIG. 15 with the TPA removed.
Figure 17:
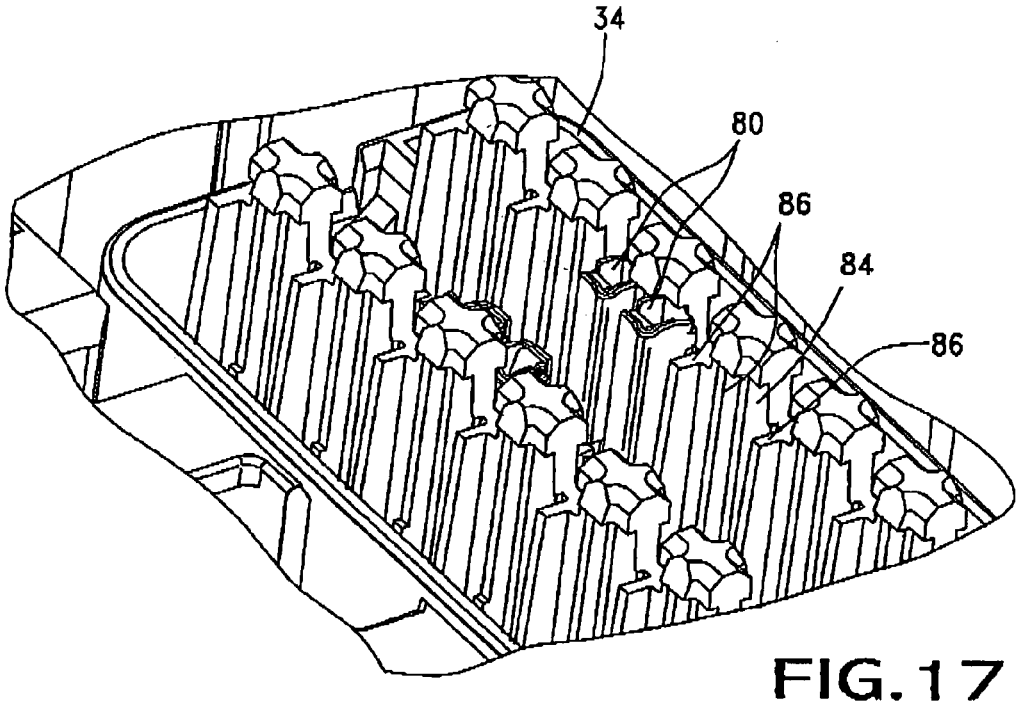
FIG. 17 is a perspective view of the connector housing and the TPA.

The connector 22 of the invention solves these molding problems in a unique system as shown in FIGS. 12–17. Specifically, FIG. 13 shows a typical conductive terminal, generally designated 80, which may be stamped and formed of conductive sheet metal material and includes an elongated contact portion 82 of a rectangular or square configuration. It is extremely difficult to mold thin walls that run the entire length of the terminal in a single structure, such as housing 34. Consequently, as seen in FIGS. 12A, 15 and 16, housing 34 is molded with a plurality of back walls 84 and a plurality of projecting "half walls 86". This wall configuration 84/86 forms a generally U-shaped wall structure 84/86 for the elongated contact portion 82 of each terminal 80. Similarly, TPA 46 includes a plurality of back walls 88 and a plurality of projecting "half walls 90" which form U-shaped wall structures 88/90 as seen in FIGS. 14, 15 and 17. As a result, each back wall 84 of housing 34 and the corresponding back wall 88 of TPA 46 define opposite sides of a cavity for receiving the terminal. Half walls 86 of the housing and half walls 90 of the TPA combine to form the other opposite side walls of the terminal cavity. As can be appreciated, it is much easier to mold the U-shaped wall structures by separating molding dies, than it is to mold a completely enclosed wall structure, particularly in very high density terminal arrays. Although this unique system is shown herein in a lever type connector, it is applicable for use in other connector assemblies.

Connector assembly 20 is provided with a unique feature which prevents vibrations between actuator connector 22 and mating connector 24. In the manufacture of electrical connectors, whether they be the lever type connectors shown herein or in other types of connectors, in order to ensure proper fit between two mating connectors and to allow the terminals and terminal pins to properly engage, there must be a nominal "play" between the bodies or housings of the connectors. This play ensures that, under dimensional variations due to manufacturing tolerances, the connectors still can fit properly. Unfortunately, this nominal play allows relative movement of the connectors due to vibrations which, in automotive applications, can be quite severe, particularly when the connector assembly is subjected to impact forces during vibration. Connector assembly 20 eliminates the relative movement between the mating connector housings after full mating engagement. Generally, this is accomplished by creating considerable interference between the connector housings at fully mated condition.

Specifically, the novel system herein creates an interference between the housings by overstraining the assembly, but only during a second or latter part of the mating engagement. As described above in relation to FIG. 1, mating connector 24 has a plurality of abutment platforms 32 defining interference surfaces 32*a* which face actuator connector 22 during mating. Housing 34 of actuator connector 22 has a bottom peripheral flange 94 which defines a peripheral interference surface which engages the interference surfaces 32*a* of all abutment platforms 32. It should be noted that by placing the abutment platforms at the corners of plug housing 26 of mating connector 24, the abutment platforms form symmetrically spaced pairs of abutting surfaces 32*a*/94 peripherally of the connector housings.

Referring to FIGS. 3–5, it can be seen that when the connectors are preliminarily mated as shown in FIG. 3 to unlatch latch arms 68 of slide members 48, abutment platforms 32 and their interference surfaces 32*a* are spaced from the flange or surface 94 of housing 34 of the actuator connector. After lever structure 52 is released and moved in the direction of arrow "C" to an intermediate position shown in FIG. 4, it can be seen that inference surfaces 32*a* of abutment platforms 32 already have engaged flange 94, but lever structure 52 has not as yet been pivoted to its fully mated position. In other words, housings 26 and 34 of mating connectors 24 and 22, respectively, are in engagement at spaced points between the connectors. In actual practice, when lever structure 52 is in its intermediate position, it is approximately 30° from its final or fully mated position, although this angle can vary depending on the configurations of the connector terminals or other components. Now, when mating assist lever structure 52 is pivoted from the intermediate position of FIG. 4 to the fully mated position of FIG. 5, the housings are overstrained and in a very tight interengagement. Basically, during a first part of the actuating stroke of lever structure 52, connectors 22 and 24 are guided into mating condition, the respective terminals are interengaged, and surfaces 32*a* and 94 of the connectors are abutted. During a second part of the actuating stroke, the connectors are overstrained. This prevents the problematic vibrations between the housings which might otherwise occur due to the normal play built into the connector components.

In essence, the bottom flange or surface 94 engages interference surfaces 32*a* of abutment platforms 38 to form mechanical stops or interference means before the connector is fully mated. This interference causes the connector assembly to have a controlled deformation as the connectors are fully mated to eliminate the play between the connector housings. Although this system increases the force required to pivot lever structure 52, the force is exerted only during the last part of the pivotal operating stroke of the lever. Other interference means than platforms 32 could be used.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector (22), comprising:

a dielectric housing (26) for mounting a plurality of conductive terminals (80) respectively in a plurality of terminal-receiving cavities, the housing having a mating face for mating with a complementary mating connector (20), the housing further including at least one opening with said terminal-receiving cavities disposed on each side of the opening, and the housing having first wall means (84, 86) defining at least one side of each cavity; and a terminal position assurance device (TPA) (46) mounted across the mating face of the housing and having at least one projection received in at least one of the openings in said housing wherein the projection includes a second wall means (88, 90) defining at least an opposite side of each cavity.

2. The electrical connector (22) of claim 1 wherein said cavities are elongated generally perpendicular to the mating face of the housing, and said first (84, 86) and second wall (88, 90) means extend substantially the length of the cavities.

3. The electrical connector (22) of claim 1 wherein said first wall (84, 86) means of the housing (26) defines at least one side of a generally rectangular cavity for receiving a generally rectangular terminal (80).

4. The electrical connector (22) of claim 3 wherein said first wall means (84, 86) is generally U-shaped in cross-section to define approximately one-half of the generally rectangular cavity.

5. The electrical connector (22) of claim 1 wherein said second wall means (88, 90) of the TPA (46) defines at least one side of a generally rectangular cavity for receiving a generally rectangular terminal (80).

6. The electrical connector (22) of claim 5 wherein said second wall (88, 90) means of the TPA (46) is generally U-shaped in cross-section to define approximately one-half of the generally rectangular cavity.

7. The electrical connector (22) of claim 1 wherein said opening in said housing is positioned between opposing rows of terminal-receiving cavities.

8. The electrical connector (22) of claim 7 wherein said opening is centrally located between opposing rows of terminal-receiving cavities.

9. An electrical connector (22), comprising:

a dielectric housing (26) for mounting a plurality of elongated terminals (80) respectively in a plurality of elongated terminal-receiving cavities, the housing (26) having a mating face for mating with a complementary mating connector (20), the housing further including at least one opening with said terminal-receiving cavities disposed on each side of the opening, and the housing (26) having first wall means (84, 86) which is generally U-shaped in cross-section to define approximately one-half of a generally rectangular cavity; and a terminal position assurance device (TPA) (46) mounted across the mating face of the housing and having at least one projection received in at least one of the openings in said housing wherein the projection includes a second wall means (88, 90) which is generally U-shaped in cross-section to define approximately the other half of the generally rectangular cavity.

10. An electrical connector (22), comprising:

a first housing part (26) having at least one opening with said terminal-receiving cavities disposed on each side of the opening, and a first wall means (84, 86);

a second housing (46) part engageable with the first housing part (26) and having at least one projection received in at least one of the openings in said housing and a second wall means (88, 90); and said first (84, 86) and second wall (88, 90) means of the two housing parts combining to define different sides of a plurality of terminal-receiving cavities for mounting a plurality of conductive terminals (80), with the first wall (84, 86) means defining at least one side of each cavity and the second wall means (88, 90) defining at least an opposite side of each cavity.

11. The electrical connector (22) of claim 10 wherein said cavities are elongated and the first (84, 86) and second wall (88, 90) means extend substantially the length of the cavities.

12. The electrical connector (22) of claim 10 wherein said first wall means (84, 86) defines at least one side of a generally rectangular cavity for receiving a generally rectangular terminal (80).

13. The electrical connector (22) of claim 12 wherein said first wall means (84, 86) is generally U-shaped in cross-section to define approximately one-half of the generally rectangular cavity.

14. The electrical connector (22) of claim 10 wherein said second wall means (88, 90) defines at least one side of a generally rectangular cavity for receiving a generally rectangular terminal (80).

15. The electrical connector (22) of claim 14 wherein said second wall means (88, 90) is generally U-shaped in cross-section to define approximately one-half of the generally rectangular cavity.

16. The electrical connector (22) of claim 15 wherein said first wall means (84, 86) is generally U-shaped in cross-section to define approximately the other half of the generally rectangular cavity.

* * * * *